US005177714A

United States Patent [19]

Ganter et al.

[11] Patent Number: 5,177,714

[45] Date of Patent: Jan. 5, 1993

[54] AUTONOMOUS RADIO TIMEPIECE

[75] Inventors: Wolfgang Ganter, Schramberg; Wolfram Hodapp, Schenkenzell, both of Fed. Rep. of Germany

[73] Assignee: Junghans Uhren GmbH, Schramberg, Fed. Rep. of Germany

[21] Appl. No.: 644,330

[22] Filed: Jan. 22, 1991

[30] Foreign Application Priority Data

Jan. 31, 1990 [DE] Fed. Rep. of Germany ..... 4002723

[51] Int. Cl.[5] ..... G04C 11/02

[52] U.S. Cl. ..... 368/47

[58] Field of Search ..... 368/47-52, 368/66, 203-204

[56] References Cited

U.S. PATENT DOCUMENTS

| | | | |
|---|---|---|---|
| 3,881,310 | 5/1975 | Gerum et al. | 368/47 |
| 4,023,344 | 5/1977 | Mukaiyama | 368/47 |
| 4,117,661 | 10/1978 | Bryant, Jr. | 369/47 |
| 4,315,332 | 2/1982 | Sakami et al. | 368/47 |
| 4,650,344 | 3/1987 | Allgaier et al. | 368/47 |
| 4,823,328 | 4/1989 | Conklin et al. | 369/47 |

FOREIGN PATENT DOCUMENTS

| | | |
|---|---|---|
| 3015312 | 10/1981 | Fed. Rep. of Germany . |
| 3439638 | 5/1986 | Fed. Rep. of Germany . |
| 3510636 | 9/1986 | Fed. Rep. of Germany . |
| 3731956 | 4/1989 | Fed. Rep. of Germany . |
| 55-90883 | 7/1980 | Japan . |
| 56-79281 | 6/1981 | Japan . |

*Primary Examiner*—Vit W. Miska

*Attorney, Agent, or Firm*—Burns, Doane, Swecker & Mathis

[57] ABSTRACT

A autonomous radio timepiece (11), in particular in the form of a small travel clock or a wristwatch, is designed to operate for an extended period of time with a small battery, and to provide a reliable time display when traveling outside the reception range of a transmitter of coded time telegrams set for a certain geographical time zone. The timepiece casing (20) is equipped with a multifuncton switching device (21) and an associated decoder (23), which evaluates the combination of the momentary actuation of push buttons (22). It is thus possible by means of the switching device (21) to switch into a power saving storage state if the timepiece is not in use, and to return to normal operations.

8 Claims, 2 Drawing Sheets

AUTONOMOUS RADIO TIMEPIECE

BACKGROUND OF THE INVENTION

1. Field of the Invention

The invention concerns a radio timepiece and more particularly a small autonomous radio timepiece in the form of a small travel alarm clock or a wristwatch, with a receiver for receiving coded time information to actuate a display device. In case of a deactivated receiver, the display device is advanced by an internal time keeping circuit.

2. Description of Related Art

A radio timepiece here is not intended to signify a radio or television receiving device (worn for example on the arm) or a personal paging device that may be additionally equipped with a timepiece. Instead, radio timepiece is intended to signify a timepiece including a receiver for periodic reception of coded, absolute time information in order to derive a time display from the decoded information. The receiver is permanently tuned to at least one transmitter (usually in the long wave range). In the case of an autonomous radio timepiece, an additional time keeping circuit is provided to advance the time display during intervals in which—because the receiver is deactivated to save energy or because of transmission interruptions—no valid time information is being received. For additional information relative to a radio timepiece of this type, reference is made to DE-OS 37 31 956 herein incorporated by reference. While the radio timepiece described in DE-OS 37 31 956 is equipped with manually actuated push buttons, these do not concern the operation of the radio timepiece proper in the sense of the display of the instantaneous absolute time information received and the internal advancement of the display based on the received information, or the next verification display as the result of new radio reception information. These push buttons merely serve to set an alarm and deactivate an alarm signal when the set point in time has been attained.

OBJECTS AND SUMMARY OF THE INVENTION

One object of the invention is to improve the radio timepiece of the prior art relative to its purpose to provide an efficient, small portable timepiece in the form of a travel clock or a wristwatch. In particular, the present invention addresses certain fundamental problems concerning the operating life of a small battery and concerning radio timepiece operation outside the geographic zone of operation of the time telegram transmitter, the transmissions of which are supposed to be received.

This object is essentially attained according to the invention by a radio timepiece equipped with a multifunction switching device having a plurality of push buttons, whereby the timepiece may be switched between a power saving storage state and an operating state. The multifunction switching device also selectively permits, with the temporary actuation of the receiver, the erasure of the contents of a time register, which is then incremented by an internal time keeping circuit, or, alternatively the temporary deactivation of only the display device following the time register, in order to subsequently accept the advancing content of the time memory even if it has not been verified and possibly corrected by absolute time information received by the radio.

This solution provides, by means of a readily manipulated multiple push button switching device, the possibility of placing the timepiece, for example a travel clock outside the verification period, into an extreme power saving condition, from which it may be returned to the operating state simply by actuating a button, whereupon the radio timepiece automatically sets itself in a known manner to the prevailing legal time. Furthermore, it is possible with this multifunction switching device to switch to a time display of equal accuracy, but in adjacent time zones by incrementing or decrementing the hour display. Finally, it is possible with this multifunction switching device to operate or start up the timepiece far away from the time zone of the transmitter without the risk that an accidental or playful activation of the receiver will result in reception of unusable time information and thus falsify the heretofore still valid time information.

Further alternatives and developments, together with additional characteristics of the invention will become apparent from the following description (including the abstract) of a preferred example of an embodiment of the solution of the invention and the drawings where like parts bear like reference numbers.

DESCRIPTION OF THE PREFERRED PRESENTLY EMBODIMENT

Figure 1:
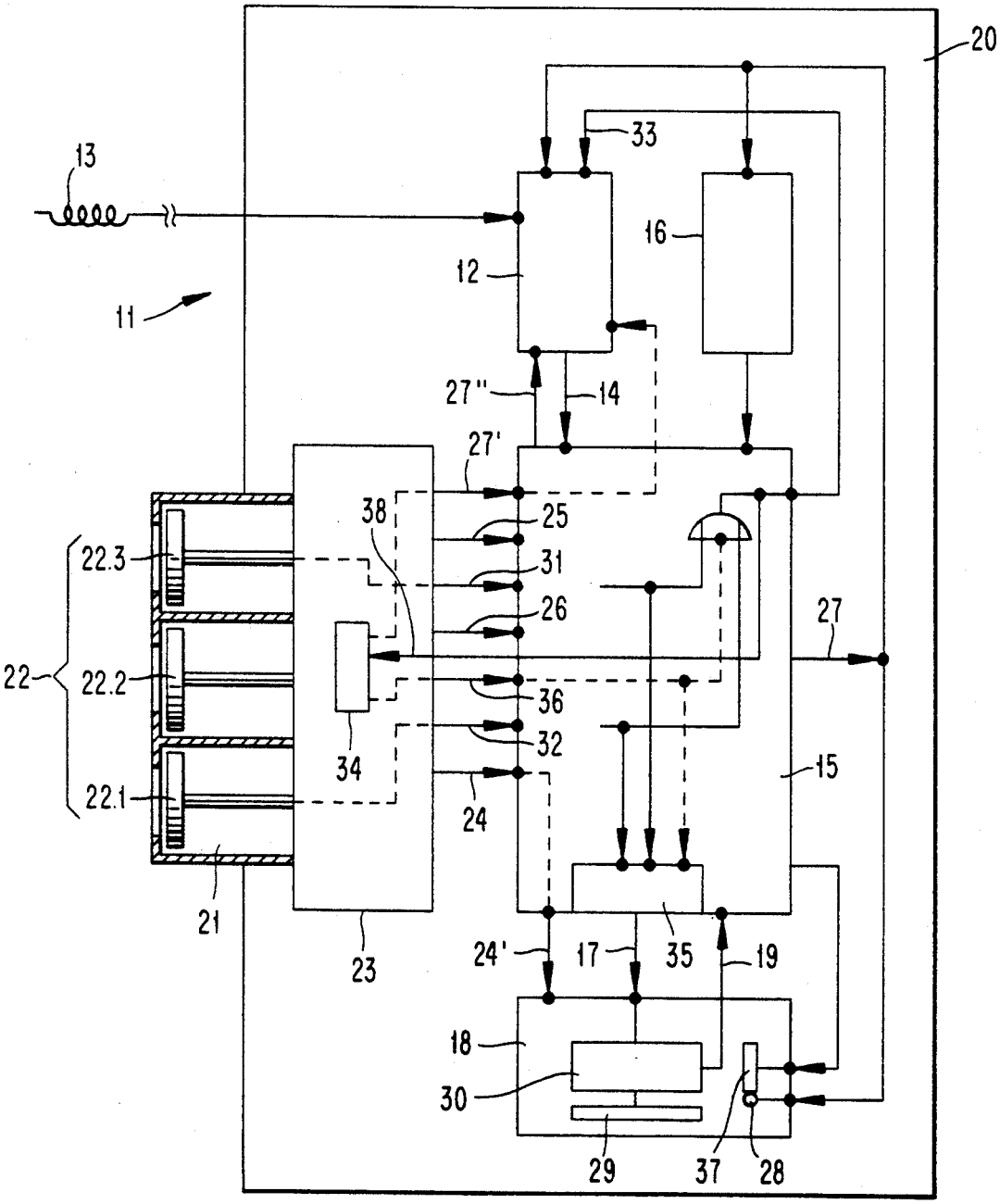
FIG. 1 of the drawing shows in a small autonomous radio timepiece 11 with a receiver 12 tuned fixedly to a time telegram transmitter, the receiver 12 potentially being retunable.

FIG. 1 shows in a small autonomous radio timepiece 11, for example in the form of a wristwatch, with a receiver 12 permanently tuned to a time telegram transmitter, the receiver 12 possibly being retunable. The receiver 12 is served by an antenna 13, which is a magnetic antenna 13 with an antenna coil on a flexible core encased in a wristwatch bracelet (not shown), for example, attached to the casing 20.

The absolute time information 14 output by the receiver 12 after the demodulation of the radio signal received, is transferred into a register 15. The valve of register 15 is then advanced by an internally autonomous time keeping circuit 16 in order to periodically provide control signals 17 for the clock time display device 18. The display device 18 may be in the form of an electrooptical display or an electromechanical display device to exhibit analog or digital information. In case of an electromechanical display device 18, a feedback signal 19 concerning the instantaneous display position (i.e., for example, the instantaneous angular position of the hands or the positioning of numerical displays) is provided. The feedback signal 19, when received, actuates display correction from the valve in the register 15 when a deviation is found between the received time information and instantaneously contained time information, as is known in the case of radio timepieces of this type. See, e.g., DE-OS 3731956.

The radio timepiece casing 20 is additionally equipped with a manually accessible and actuable multifunction switching device 21, which preferably comprises three individually actuable push buttons 22.1, 22.2 and 22.3. The instantaneous actuating combination of the push buttons is decoded in a decoder 23 and serves to actuate the aforementioned functional elements of the radio timepiece 11.

Figure 2:
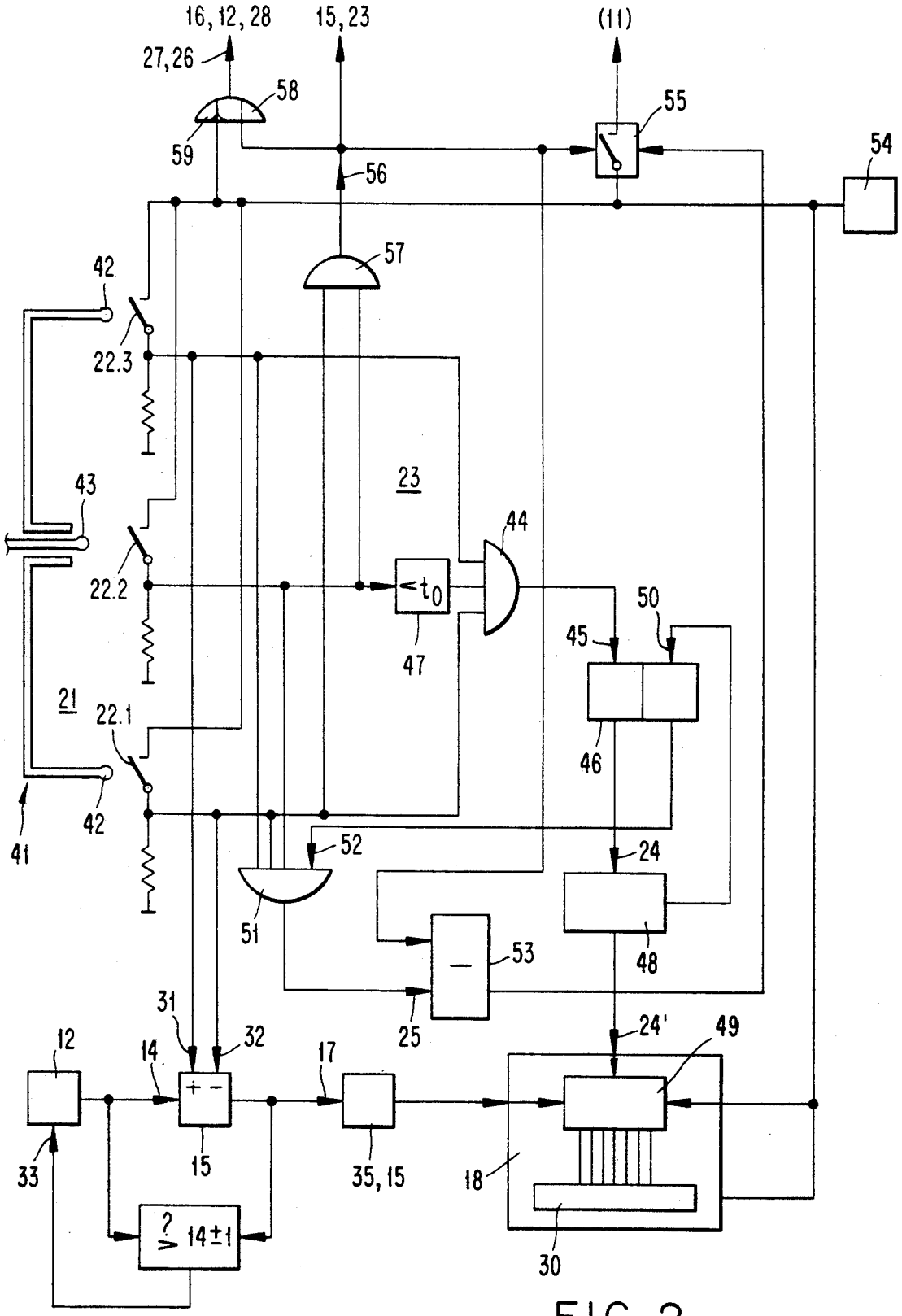
FIG. 2 shows a basic circuit diagram for querying a switch relative to the switching functions as explained in relation to FIG. 1.

By means of the switching device 21, for example, in the course of quality testing to complete the manufacturing process, a test cycle may be run through, which is of interest when using a electrooptical display device 18. For the purpose, the decoder 23 provides a test signal 24 if two of the push buttons 22 are depressed simultaneously and the third push button 22 depressed only temporarily—an actuation pattern of the switching device 21 which cannot be random or accidental. As shown in FIG. 2, in the case of recessed push buttons this actuation of a test cycle is best carried out by means of a multiple punch tool 41 with two stationary punches 42 and a mobile punch 43 (to be additionally actuated). Therefore, if the two stationary punches close, for example, the push buttons 22.1 and 22.3, the AND gate 44 is prepared. The signal from the two push buttons 22.1 and 22.3 is passed through and delivers a setting signal 45 to a bistable flip-flow stage 46 if a timing element 47 is actuated. Timing element 47 is actuated when the mobile punch 43 temporarily closes the center push button 22.2, i.e., not longer than a period of time determined by the timing element 47. The test signal 24 generated by the flip-flop stage 46 starts a counter 48 and therefore leads to a sequence of counting signals 24', which, by means of a control circuit 49, briefly activates display 30 (to be explained below) in the normal range, i.e., the segments for all the potentially occurring alphanumerical information are successively activated. An overrun signal 50, which appears at the end of the volume of the counter 48, resets the flip-flop stage 46, thereby deactivating the counter 48.

After this successful production test, or at any other time, the energy consumption of the radio timepiece may be reduced to a minimum. For this, almost the entirety of the circuit is placed into a "sleep" mode by the simultaneous actuation of only two push buttons (i.e., not with the tool 41). For example, upon the simultaneous actuation of two of the push buttons 22.2 and 22.3, the decoder 23 emits a saving signal 25 through an AND gate 51, which is prepared by a rest signal 52 from a counter flip-flop 46. Another bistable flip-flop stage 53 is set by the saving signal 25 in order to open a load switch 55, the load switch positioned at the power source (battery or storage means) for nonessential functions of the timepiece 11. The basic operations of the radio timepiece 11 are thus deactivated. A brief information appears on the display device 18 to indicate that the timepiece 11 or its display device 18 are not defective, but are in their saving mode.

The timepiece 11 may be returned into its operating state simply by again closing the switch 55 by means of a start signal 56 from an AND gate 57, the start signal 56 also resetting the flip-flop stage 53 register 15 and decoder 23. The AND gate 57 switches on when the push buttons 21.1 and 22.2 are closed in the example shown. In order to insure a defined startup of the operation of the radio timepiece 11, it is appropriate to actuate a reset signal 26, 27 by means of the start signal 56 through an OR gate 58. The reset signal 26 is fed to time keeping circuit 16, receiver 12 and a blinking display 28. The reset signal 26 not only erases all of the memories in the evaluating circuits of the radio timepiece 11, but in particular, a processor is set into a defined initial program state for an error-free start of the program, to control the decoder itself 23 and the register 15 (FIG. 1) for the conversion of the received and decoded time information into a display.

A dynamic input 59 of the OR gate 58 insures that the reset signal 26 is actuated not only by the manually actuated start signal 56, but that the reset signal 26 appears also if the power source 54 is activated (for example if a new battery is inserted). The reset signal 26 acts as the actuating signal 27 for the receiver 12 (FIG. 1) and the receiving operation initiated by the actuating signal 27 is indicated by a blinking display 28 (FIG. 1). The internal timekeeping circuit 16 is also actuated by the actuating signal 27 so that the internal time information is incremented which is displayed on the display device 18 (in particular its seconds display).

However, as soon as the receiver 12 provides time information 14 which can be evaluated, the display switches to a special display area 29 (for example the calendar display) of the display device 18, to indicate that, while a certain radio time information 14 is being offered, no secured instantaneous absolute time information is as yet available. Only when an instantaneous absolute time information 14 assured by the comparison of successive time information will this complete information be displayed in the normal range of the time display 30 of the display device 18, i.e., in the case of an electrooptical digital display by the hour, minute and seconds indications. The receiver actuation signal 27 then disappears, but the internal time keeping circuit 16 continues to run once it has been started. With the deactivation of the receiver 12, the reception indication 28 also disappears and the information display in the normal range 30 is now advanced by the internal time keeping circuit 16.

However, at points in time set in the register 15, for example daily at 2 AM, a new actuation signal 27 is emitted in order to-correct the instantaneous time display in the normal range 30 of the display device 18, should it deviate from the absolute time as determined by radio.

The receiving range of the receiver-antenna combination 12–13 typically extends not only over the one time zone in which the time telegram transmitter (for example a DCF transmitter) to which the receiver 12 is tuned, is installed, but also far into the adjacent geographical time zones. In order to adjust to a different geographical time zone than the time zone of the time telegram transmitter to which the receiver 12 is tuned, it is merely necessary to alter the hours displayed at the time in hourly steps, while the minute and seconds displays remain unaffected. As shown in FIG. 2, this may be carried out by the repeated actuation of the push buttons 22.3 or 22.1, which transmit the corresponding hour addition or hour subtraction signals 31, 32 respectively, by means of the register 15 to the time memory 35 for the display device 18.

When located in a time zone adjacent to that of the transmitter, any newly received time information 14 will switch the hour display back to the original time zone, which must again be corrected manually by means of the push buttons 22.3 or 22.1, as described above. Beyond the two adjacent time zones on either side, the probability that the receiver 12 will be able to provide usable time information 14 is slight. To prevent erroneous displays or unnecessary interruptions of the display during attempts to receive which are likely to be futile, a blocking signal 33 is sent to the receiver 12

(which deactivates the receiver 12) whenever the time switch 34 determines that the manually set hour display is different by more than one hour from the hour indication that would be valid in the vicinity of the transmitter according to the time information 14.

This blocking of the receiver 12 in the power saving deactivated setting may be eliminated either by canceling the manual setting of the hour display by means of the push buttons 22.1 or 22.3, or by resetting the time memory 35 in the register 15 containing the hourly setting into its zero initial state by effecting a new start according to the initial startup described above (by inserting a battery or terminating the sleep mode). This resetting of the time memory 35 while erasing the display 18 may also be effected by depressing one of the push buttons 22.2 beyond a specific minimum length of time, which may be queried by a time switch 34 in the decoder 23 (FIG. 1). The decoder 23 emits, in this case, a reset signal 36 to the time memory 35, whereby the blocking signal 33 may simultaneously be released. When the push button 22.2 is released after the specified minimum length of time, the display 18 in the normal range 30 of the display begins to increment under the control of the internal time keeping circuit 16. Following this, it is merely necessary to set the prevailing hour display by means of the manually operated addition or subtraction signals 31, 32. In this manner, upon the reception of an hour indication, for example of a radio network transmitter, the minute and seconds display may be started with seconds accuracy at the full hour, if at the time of the activation of the timepiece there is no contact with the proper transmitter due to momentarily unfavorable receiving conditions. The actuated receiver 12 then attempts to replace this manually 10 started display with a confirmed absolute time information 14 as soon as possible.

If, on the other hand, during the normal operation of the radio timepiece 11 the reset push button 22.2 is operated briefly only, the time switch 34 emits an actuating signal 27' (FIG. 1) acting on the receiver 12. This so-called "transmitter call" erases the display in the normal range 30 of the display device 18, but the time memory 35 is not reset and is continuously advanced from the autonomous time keeping circuit 16. If now the actuated receiver 12 provides a time information 14 that is plausible (compared with the continued time information in the memory 35) or a previously received time information 14, it is entered into the time memory 35 and the display. Otherwise, the internally advanced time information is again transferred from the memory 35 to the display device 18, if the receiver is not able to provide a plausible time information 14 over a given receiving period, due for example to unfavorable radio transmission conditions. While in this case the absolute accuracy of the time information again displayed has not been confirmed by radio, it is correct with an adequate degree of probability, as it represents a display of the internally continued earlier time indication, without a terminal interruption of the time display (until the periodically actuated receiver 12 again provides a correct time information 14). Conveniently, this mere display reset function that may be actuated by the "transmitter call" push button 22.2 is blocked beyond the adjacent times zones during manual hour setting by a blocking signal 38, since, as mentioned above, no reliable reception of radio time telegrams is to be expected.

The display device 18 conveniently has an additional control display 37, on which may be indicated numerically, from the register 15, how long it has been since (for example how many days) the automatic nightly actuation by means of an actuating signal 27'' of the receiver 12 has not lead to the decoding of a usable instantaneous time information 14. This control display is also increased by one unit each time the receiver 12 is actuated by the so-called "transmitter call button", the push button 22.2, by 20 means of the manual actuating signal 27' (FIG. 2). However, the receiver 12 is then deactivated without obtaining a valid time information 14 after a certain period of operation in order to save power. When the display volume of the control display 37 is counted to its maximum value, i.e., in the case of a single digit digital display after nine unsuccessful receiver actuations, the highest indication is retained. It is reset to zero whenever the automatic or manual receiver actuation again leads to the acquisition of a usable time information 14.

The control display 37 may be structurally combined with the receiving display 28, by causing the control number to blink while the timepiece 11 is receiving. To avoid possible irritations, conveniently the control display 37 is entirely discontinued if it would indicate "zero", because the instantaneous time display has been confirmed by a previous actuation of the receiver.

Additional information regarding the operation of radio controlled timepieces is available from U.S. Pat. Nos. 4,117,661 to Bryant Jr., 4,023,344 to Mukaiyama, 4,315,332 to Sakami et al., 4,823,328 to Conklin et al., Federal Republic of Germany patents DE 34 39 638, DE 30 15 312, DE 35 106 36 and Japanese patent publications 56-79281 and 55-90883, herein incorporated by reference, for example. It will be understood that the above-description of the preferred embodiment is not limitative, and the scope of patent protection is to be determined from the appended claims in which we claim:

We claim:

1. An autonomous radio timepiece, comprising:

a receiver for receiving and decoding coded time information;

a display device for displaying time information from said decoded time information received and decoded by said receiver;

an internal time keeping circuit for advancing said display of said time information of said display device when said receiver is deactivated; said circuit comprising a time register for storing a time value; and a multifunction switching device including a plurality of push buttons, for switching between a power saving state wherein part of said timepiece is turned off and an operating state wherein all of the circuitry of said timepiece is powered, whereby, when said receiver is temporarily actuated, said time register is erased and then incremented by the internal time keeping circuit, and whereby only said display device is temporarily deactivated and the time value of the time register is displayed on the display device even if said time register has not been verified and corrected, as necessary, by the coded time information received and decoded by said receiver.

2. The radio timepiece according to claim 1, further comprising:

a reset push button;

a time switch associated with said reset push button for discriminating when a certain actuation period has been reached, whereby an brief actuation of the push button shorter than the certain actuation period temporarily erases the display device without resetting the time register, and whereby an actuation of the push button longer than the certain actuation period causes a complete system reset to reset the entire timepiece into an initial operating state.

3. The radio timepiece according to claim 1, further comprising a means for manual setting of the hour display and whereby when said manually set hour display deviates by more than one hour from the coded time information received by radio, the actuation of the receiver is blocked.

4. The radio timepiece according to claim 2, further comprising a means for manual setting of the hour display and whereby when said manually set hour display deviates by more than one hour from the coded time information received by radio, a blocking signal is emitted for the time switch thereby enabling a system reset only.

5. The radio timepiece according to claim 1, wherein the display device further comprises a normal display segment and a special display segment and whereby the display device initially displays the decoded time information and is advanced by the internal time keeping circuit, whereupon the reception of time information said display device switches to the special display segment for the display of the time information obtained by said receiver and the time information is transferred after verification to the normal display segment provided for the purpose of the displaying time information.

6. The radio timepiece according to claim 1, wherein a digital control display segment is provided, which at a predetermined time each day and upon each manual receiver actuation of said receiver, the digital control display advances by one unit in case of an unsuccessful attempt to obtain valid time information, but is reset into its initial counting position and then deactivated if a valid time information is received.

7. The radio timepiece according to claim 6, wherein said digital control display segment also serves as a blinking reception indicator when said receiver is actuated.

8. The radio timepiece according to claim 1, wherein the switching device is also capable of adjusting the contents of the display device by predetermined time display steps.

* * * * *